United States Patent [19]

Park

[11] Patent Number: 4,908,488

[45] Date of Patent: Mar. 13, 1990

[54] FIXING DEVICE OF A HEATING MEMBER IN A COMBINED MICROWAVE AND CONVECTION COOKING APPARATUS

[75] Inventor: Hwa S. Park, Kyunggi, Rep. of Korea

[73] Assignee: Samsung Electronics Co., Ltd., Rep. of Korea

[21] Appl. No.: 381,856

[22] Filed: Jul. 19, 1989

[30] Foreign Application Priority Data

Jul. 22, 1988 [KR] Rep. of Korea ..... 1988-11931

[51] Int. Cl.[4] ..... H05B 6/64; F27D 7/04

[52] U.S. Cl. ..... 219/10.55 R; 219/10.55 B; 219/10.55 E; 219/400; 126/21 A

[58] Field of Search ..... 219/10.55 R, 10.55 B, 219/10.55 E, 400; 126/21 A, 21 R, 273 R, 275 E; 312/236

[56] References Cited

U.S. PATENT DOCUMENTS

| | | | |
|---|---|---|---|
| 4,283,614 | 8/1981 | Tanaka et al. | 219/10.55 R |
| 4,481,396 | 11/1984 | Matsubayashi et al. | 219/10.55 B |
| 4,627,409 | 12/1986 | Kagomoto | 126/21 A |
| 4,780,596 | 10/1988 | Matsushima et al. | 219/400 |

*Primary Examiner*—Philip H. Leung

*Attorney, Agent, or Firm*—Saidman, Sterne, Kessler & Goldstein

[57] ABSTRACT

A fixing device of a heating member in a combined microwave and convection cooking apparatus includes inner and outer case members having flanges respectively, an upper plate of a heating cavity provided with first and second holders, and a heating member assembly including fixing and supporting members for firmly fixing and supporting the heater in the inner case member. When the device is assembled and fixed, the flanges of the inner and outer case members are inserted within the first and second holders respectively for preventing the leakage of the air heated by the heater.

1 Claim, 2 Drawing Sheets

FIXING DEVICE OF A HEATING MEMBER IN A COMBINED MICROWAVE AND CONVECTION COOKING APPARATUS

BACKGROUND OF THE INVENTION

1. Field of the Invention

The present invention relates to a combined microwave and convection cooking apparatus, and more particularly to a fixing device of a heating member in a combined microwave and convection cooking apparatus which can be easily mounted on an upper plate of a heating cavity by means of bolts and nuts.

2. Description of the Prior Art

In the conventional fixing device of a heating member in a combined microwave and convection cooking apparatus, the heating member is fixed downwardly of a case in which a thermally insulating material is inserted.

Such type of fixing device, however, suffers from the disadvantages that the heat generated by the heating member may be leaked out through a gap between the upper plate of the heating cavity and the case, and thereby the heat loss is great and the damage to the accommodated components may be occurred. Furthermore, the conventional fixing device has problems that disadvantageous movement of the heating member may be occurred due to the use of a number of fixing screws, and that it is necessary to loose a number of fixing screws for repairing the heating member.

SUMMARY OF THE INVENTION

It is an object of the present invention to provide a fixing device of a heating member in a combined microwave and convection cooking apparatus which is simple in structure by reducing the number of fixing screws used in fixing the heating member and can be prevented from moving.

It is another object of the present invention to provide a fixing device of a heating member in a combined microwave and convection cooking apparatus which can increase the thermal efficiency of the apparatus and prevent the accommodated components from damage due to overheating.

In accordance with the present invention, there is provided a fixing device of a heating member in a combined microwave and convection cooking apparatus comprising:

a case including inner and outer case members having flanges respectively and fixed with each other by means of screws, and a thermal insulator inserted between the inner and outer case members;

an upper plate of a heating cavity having a plurality of inlet and outlet holes formed thereon for the heated air and provided with first and second holders for inserting and supporting the flanges of the inner and outer case members therein; and a heating member assembly including heating means installed between the inner case member and the upper plate, fixing and supporting members for respectively fixing and supporting the heating means on the inner case member, and a fan for circulation of the heated air disposed between the inner case member and the upper plate of the heating cavity and connected to a rotating shaft which passes through the center of the inner and outer case members.

BRIEF DESCRIPTION OF THE DRAWINGS

The present invention will now be described by way of illustrative examples with reference to the accompanying drawings, in which.

DETAILED DESCRIPTION OF THE PREFERRED EMBODIMENT

Figure 1:
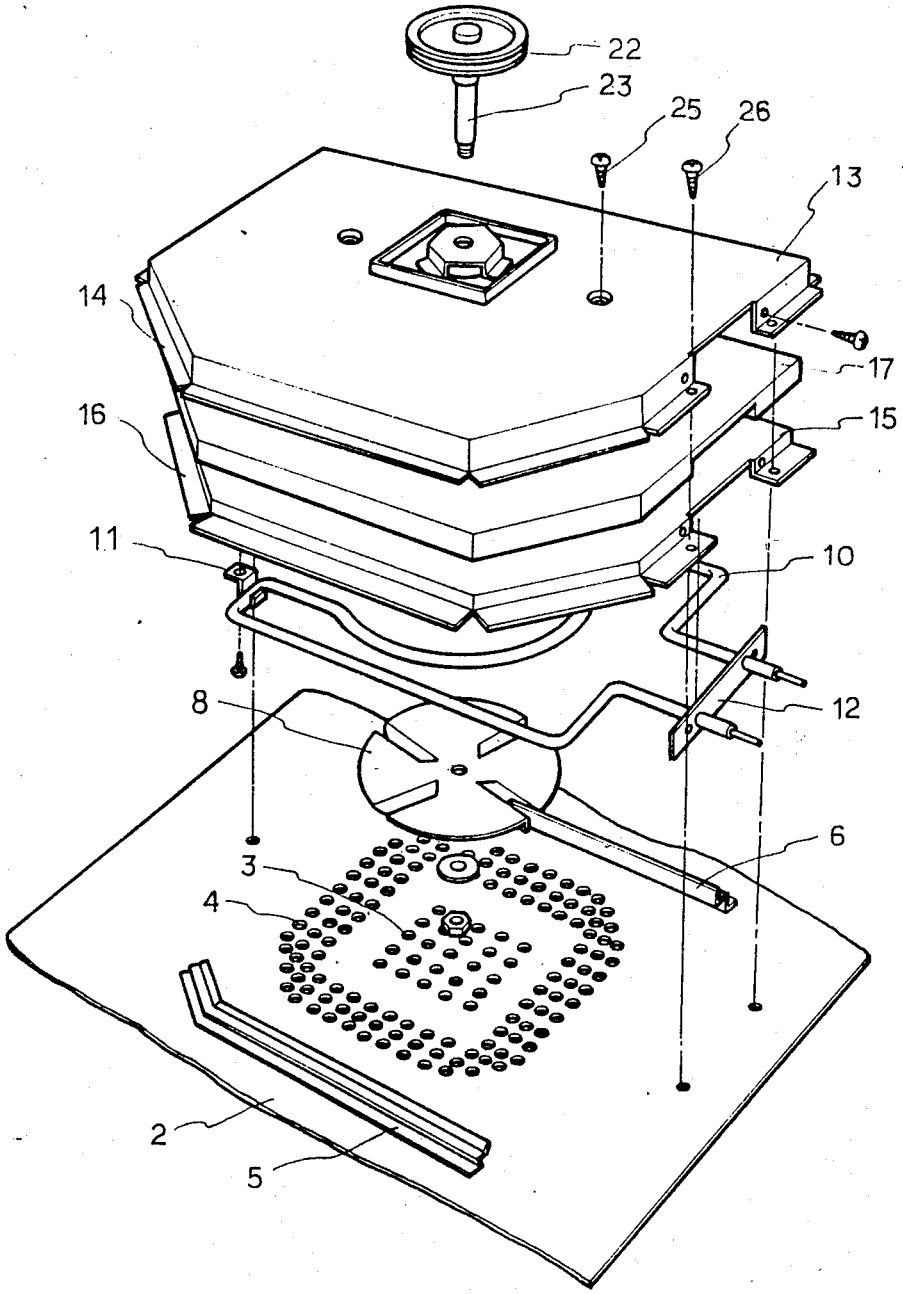
FIG. 1 is a partially exploded perspective view showing the embodiment of the present invention.
Figure 2:
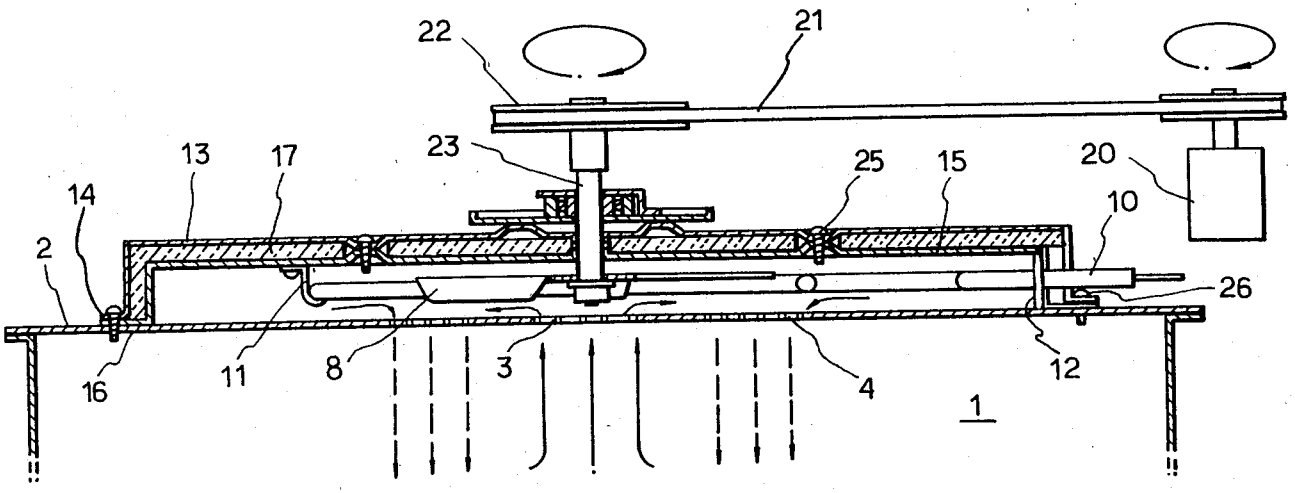
FIG. 2 is a sectional view taken along line X—X of FIG. 1.

Referring to FIGS. 1 and 2, a thermal insulator 17 and an inner case member 15 are inserted inwardly of an outer case member 13, and then the flanges 16 and 14 of the inner and outer case members 15 and 13 are fixed together by means of a set of screw 25 in order to constitutes case.

A support member 11 is provided on the inner surface of the inner case member 15 so that a heating member 10 fixed on the outer and inner case members 13 and 15 by a fixing plate 12 can be fitted and supported therein, a rotating shaft 23, to the one end of which a pulley 22 is connected, passes through the center of the inner case member 15 and the other end of the rotating shaft 23 is connected to a fan 8 in order to constitute a heating member assembly.

Furthermore, first and second elongated holders 5 and 6 are welded on an upper plate 2 of a heating cavity 1 so that the flanges 16 and 14 of the inner and outer case members 15 and 13 of the heating member assembly are fitted and supported within the first and second holders 5 and 6. On the upper plate 2, pluralities of inlet and outlet holes 3 and 4 are formed in order to circulate the air heated by the heating member 10. The heating member assembly is fixed to the upper plate 2 of the heating cavity 1 by means of a set of screw 26.

In this embodiment of the present invention, the heating member 10 is supported by the supporting member 11 which is fixed to the inner case member 15, the flanges 16 and 14 of the inner and outer case members 15 and 13 are inserted into the first and second elongated holders 5 and 6 respectively, and then the heating member assembly is fixed by means of the set of screw 26 to the upper plate 2. Thus the heating member 10 can be prevented from moving and the assembly can also be readily assembled.

When the electric power is applied to the apparatus, the heating member 10 is energized and the heat is generated by the heating member 10. At this moment, a motor 20 is also rotated and the rotating force of the motor 20 is transmitted to the rotating shaft 23 by means of a belt 21 and the pulley 22, causing the rotating shaft 23 to rotate. Accordingly, the air in the heating cavity 1 is circulated through the inlet and outlet holes 3 and 4 while being heated by the heating member 10.

In this manner, the air in the heating cavity 1 is drawn in through the inlet holes 3, heated by the heating member 10 and then expelled to the heating cavity 1 through the outlet holes 4 which are formed outwardly of the inlet holes 3 in order to perform the convection cooking.

Since the one end of the heating member 10 mounted within the inner case member 15 is fixed to the inner and outer case members 15 and 13 by means of the fixing plate 12 while the other end thereof is supported by the support member 11 fixed to the inner surface of the inner case member 15, the heating member 10 can prevent from being moved. Also, the manufacturing cost can be reduced in comparison with the conventional device using material such as plastic or ceramic for fixing the heating member as being properly spaced from the upper plate 2.

Additionally, the inner and outer case members 15 and 13 are assembled in such a manner that the flanges 16 and 14 of the inner and outer case members 15 and 13 are inserted within the first and second holders 5 and 6 which are welded to the upper plate 2, and then the assembled inner and outer case members 15 and 13 and the upper plate 2 of the heating cavity 1 are firmly fixed by means of the set of screws 26. Thus the thermal efficiency of the apparatus can be increased, and disassembling and assembling of the device become easier.

As described above, the first and second elongated holders 5 and 6 are welded to the upper plate 2 and the flanges 16 and 14 of the inner and outer case members 15 and 13 are fitted into the holders 5 and 6 respectively. Thus, it is possible to reduce the number of screws used for fixing the upper plate 2 of the heating cavity 1, and the amount of time required in disassembling and assembling of the device can be reduced.

On the other hand, according to the embodiment, since the flanges 16 and 14 of the inner and outer case members 15 and 13 are closely in contact with the upper plate 2 by means the first and second elongated holders 5 and 6, the leakage of the air heated by the heating member 10 can be prevented, and thereby the thermal efficiency of the apparatus is increased.

From the foregoing, it will be apparent that the present invention provides a novel fixing device of a heating member specially designed and constructed to prevent the disadvantageous movement of the heating member and to reduce the manufacturing cost because the use of a special kind of material for preventing the movement of the heating member is not required. Furthermore, the present invention provides the advantage that the thermal efficiency of the apparatus can be increased by preventing the leakage of the heated air through a gap between the upper plate and the case since the flanges of the inner and outer case members are closely in contact with the upper plate by means of the screws and the elongated holders.

While the present invention has been described and illustrated herein with reference to the preferred embodiment thereof, it will be understood by those skilled in the art that various changes in form and details may be made therein without departing from the spirit and scope of the invention.

What is claimed is:

1. A fixing device of a heating member in a combined microwave and convection cooking apparatus comprising:

a case including inner and outer case members having flanges respectively and fixed with each other by means of screws, and a thermal insulator inserted between said inner and outer case members;

an upper plate of a heating cavity having a plurality of inlet and outlet holes formed thereon for the heated air and provided with first and second elongated holders for inserting and supporting said flanges of said inner and outer case members therein; and a heating member assembly including heating means disposed between said inner case member and said upper plate, fixing end supporting members for respectively fixing and supporting said heating means on said inner case member, and a fan for circulation of the heated air disposed between said inner case member and said upper plate and connected to a rotating shaft passing through the center of said inner and outer case members.

* * * * *